US005535885A

United States Patent [19]

Daniel et al.

[11] Patent Number: 5,535,885

[45] Date of Patent: Jul. 16, 1996

[54] FRAGRANCE SAMPLE CONTAINER

[75] Inventors: Paula Daniel, New York, N.Y.; Gregory A. Schurig, Clearwater; Suzanne O'Neill, St. Petersburg, both of Fla.

[73] Assignee: R.P. Scherer Corporation, Troy, Mich.

[21] Appl. No.: 213,374

[22] Filed: Mar. 15, 1994

Related U.S. Application Data

[63] Continuation of Ser. No. 992,834, Dec. 18, 1992, abandoned.

[51] Int. Cl.[6] ..... B65D 73/00

[52] U.S. Cl. ..... 206/484; 206/469; 383/209; 383/107

[58] Field of Search ..... 206/229, 469, 206/484; 215/32; 383/200, 201, 207, 209, 107, 119

[56] References Cited

U.S. PATENT DOCUMENTS

| | | | |
|---|---|---|---|
| D. 96,951 | 9/1935 | Zupnik | 206/484 |
| 587,327 | 8/1897 | Planten . | |
| 2,134,489 | 10/1938 | Scherer . | |
| 2,329,360 | 9/1943 | Salfisberg | 206/484 |
| 2,397,051 | 3/1946 | Scherer . | |
| 3,513,052 | 5/1970 | Ariyasu et al. | 206/484 |
| 3,689,458 | 9/1972 | Hellstrom . | |
| 3,960,636 | 6/1976 | Moffitt | 383/107 |
| 4,717,046 | 1/1988 | Brogli | 206/484 |
| 4,739,778 | 4/1988 | Christie . | |
| 4,809,852 | 3/1989 | Mancini | 383/200 |
| 4,978,055 | 12/1990 | Miller | 383/107 |
| 5,009,894 | 4/1991 | Hsiao | 206/469 |
| 5,063,057 | 11/1991 | Spellman et al. . | |
| 5,082,661 | 1/1992 | Melnik et al. . | |
| 5,111,932 | 5/1992 | Campbell | 206/469 |
| 5,131,760 | 7/1992 | Farmer | 206/484 |

FOREIGN PATENT DOCUMENTS

| | | |
|---|---|---|
| 1046215 | 12/1953 | France . |
| 2206250 | 6/1974 | France . |
| 2200310 | 7/1973 | Germany . |
| 2730133 | 1/1979 | Germany . |

*Primary Examiner*—David T. Fidei
*Attorney, Agent, or Firm*—Allegretti & Witcoff

[57] ABSTRACT

The invention is a fragrance sample container comprised of a central cosmetic-containing portion substantially surrounded by a peripheral portion having thickened edges. The entire container is preferably made of soft-gelatin. The thickened edges of the peripheral portion, made of solid gelatin, serve to distribute and absorb the planar force of a weight applied to the container, in order to prevent the central cosmetic-containing portion from rupturing under the pressure of the weight. The invention is particularly useful in the distribution to potential customers of sample unit doses of fragrances or other cosmetics through the mails or in magazines.

7 Claims, 1 Drawing Sheet

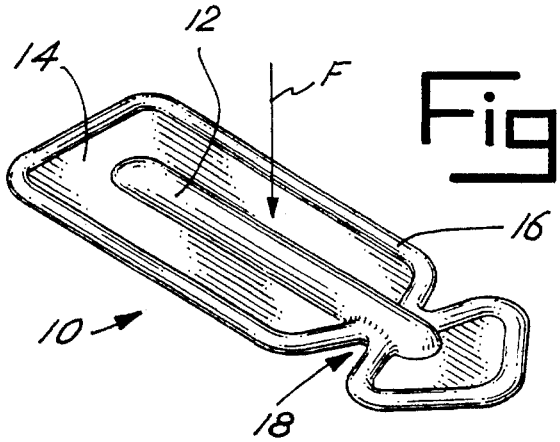
Fig. 1
Fig. 2
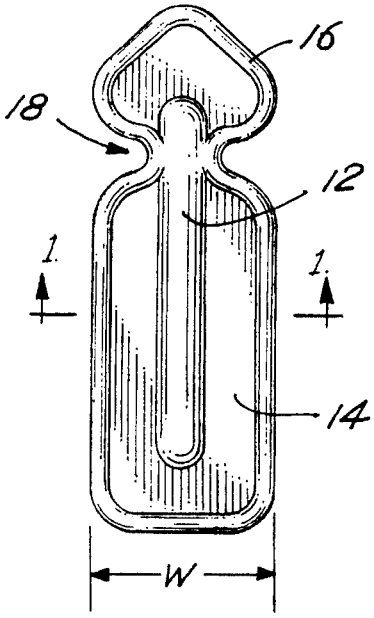
Fig. 3
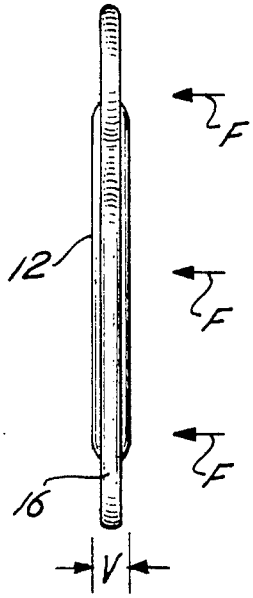
Fig. 4
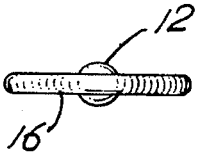
Fig. 5
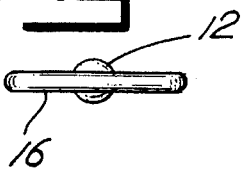
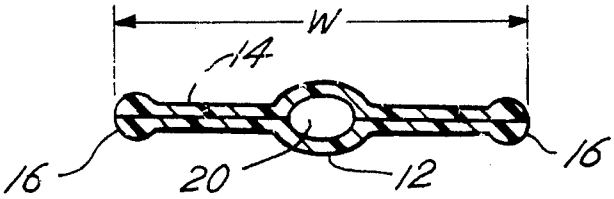
Fig. 6

FRAGRANCE SAMPLE CONTAINER

This application is a continuation application of Ser. No. 07/992,834, filed Dec. 18, 1992, now abandoned.

BACKGROUND AND SUMMARY OF THE INVENTION

1. Nature of the Invention

The present invention relates to cosmetic product containers. More particularly, the present invention relates to a fragrance sample container for containing and dispensing preferably a unit dosage of cosmetic fragrance in fluid form, while preventing most essentially planar pressures on the container from rupturing the fragrance-holding capsule. Thus, still more particularly, this invention relates to a unit-dose fragrance container that can survive the rigors of shipment through the mails or inclusion in printed material, such as a magazine.

2. Background of the Invention

It is common practice in the cosmetics industry to mail or otherwise distribute samples of fragrances to potential customers. Channels of distribution may preferably include direct mailing, in-store promotions, or inclusion in demographically appropriate periodicals. Frequently, such samples are distributed in the form of "vial-on-cards", which usually comprise a glass or plastic vial fastened to a cardboard backing. These glass or plastic vials are relatively expensive and are frequently non-biodegradable. Further, these vials are fragile and thereby susceptible to being broken when compressed. Accordingly, vial-on-cards are generally not suitable for mailing or for compression in a stack of magazines.

More recently, it has become common practice to distribute fragrance samples to potential customers by inserting scent-strips in magazines or mailings. The scent-strip process involves micro-encapsulating a fragrance and adhering it with glue to a printed magazine or mailing insert. While scent strips are easy to mail, are compressible and are relatively inexpensive, they do not present a true rendition of the fragrance to the potential customer.

Another known means for packaging a unit dosage cosmetic sample is the soft-gelatin capsule. Similar in function to plastic or glass vials, these "soft-gel" capsules contain a fluid sample of the fragrance or other cosmetic. However, unlike the plastic or glass vials, soft-gel capsules are relatively inexpensive to manufacture, and, in addition, are biodegradable.

For instance, U.S. Pat. No. 5,063,057 (Spellman et al.) discloses a "Saturn-like" soft-gelatin capsule comprising a round (essentially spherical) body with a hollow chamber for containing a cosmetic composition, a neck section connecting a pull tab to the round body, and, to prevent the capsule from rolling, "an outwardly projecting ring positioned along a median circumference of an outer wall of the body." (Col. 2, lines 15–17). The capsule is opened by twisting the tab until the neck section snaps and opens a passage into the chamber. "By gently squeezing the capsule walls, cosmetic composition is forced to exit through the puncture opening." (Col. 2, lines 66–68). It is apparent that the shape of the round body disclosed by Spellman could not withstand planar pressure, such as that inherent in a stack of magazines, without bursting and allowing the cosmetic contents to leak.

Similarly, other references disclose gelatin cosmetic capsules with tear-off or twist-off tabs. Examples include U.S. Pat. Nos. 2,134,389 (R. P. Scherer) and 2,397,051 (J. O. Scherer). The capsules disclosed by each of these references, however, suffer from the same flaw as that disclosed by the Spellman patent. Namely, none of these gelatin capsules is capable of withstanding substantial and essentially planar pressure without rupturing and permitting the cosmetic contents to escape.

It is therefore an object of the present invention to provide a unit-dosage fragrance sampler that can be substantially compressed by a planar force without bursting. Supplementary objects of this invention include providing a unit-dosage fragrance sampler that:

permits distribution via the mails or in magazines or other printed material;

presents a true rendition of the fragrance;

is cost effective to manufacture; and is biodegradable.

SUMMARY OF THE INVENTION

Accordingly, the present invention provides a cosmetic sample container useful for containing and dispensing preferably a unit dosage Of fluid-form fragrance. In the preferred embodiment, the invention is made of gelatin and comprises a substantially cylindrical narrow central portion, and a peripheral portion with thickened edges. The central portion is a hollow chamber and serves to contain a fluid-form fragrance. The peripheral portion is preferably planar and extends from the central portion. At least two opposing outer edges of the peripheral portion are thickened solid gelatin, and, in the preferred embodiment, are parallel to the central portion. The thickened edges need not be as thick as the central portion. Further, in the preferred embodiment, the overall width of the fragrance sample container is at least three times the width of the central portion. However, the peripheral portion may have a reduced width at a twist-off or neck portion, in order to provide easy access to the contents of the central portion.

The thickened solid edges of the peripheral portion serve to buffer the central fluid-containing portion against the force of a weight applied substantially perpendicular to the plane of the peripheral portion and spread over a plane substantially parallel to the peripheral portion. Thereby, for instance, the thickened edges help to distribute the compressive force of a stack of magazines around the entire cosmetic sample container, rather than allowing the force to solely impact and probably rupture the central fluid-containing portion.

As is apparent from the above discussion of the existing art, without the thickened edges of the present invention, the weight of stacked magazines would cause the central fluid-containing portion to compress and fracture, resulting in unacceptable leakage. The present invention, however, provides a novel solution to this problem, allowing much of the weight from the stacked magazines to be absorbed by the thickened edges, and thereby permitting the central portion to remain intact.

BRIEF DESCRIPTION OF THE DRAWINGS

There is shown in the attached drawings a presently preferred embodiment of the present invention, wherein like numerals in the various views refer to like elements and wherein:

FIG. 1 is a perspective view of a fragrance sample container made in accordance with the present invention;

FIG. 2 is a front and back plan view of the fragrance sample container, the front and back plan views being identical;

FIG. 3 is a left and right side view of the fragrance sample container, the left and right side views being identical;

FIGS. 4 is a top view of the fragrance sample container;

FIG. 5 is a bottom view of the fragrance sample container; and

FIG. 6 is a cross sectional view of the fragrance sample container taken along line 1—1 of FIG. 2.

DETAILED DESCRIPTION

FIG. 1 shows a perspective view of a fragrance sample container 10 made in accordance with the present invention. Container 10 comprises a central fluid-containing portion 12, and a peripheral portion 14 having thickened edges 16. In the preferred embodiment, the container 10 is shaped to present the appearance of a fragrance bottle, having a reduced width neck portion 18, at which point easy access to the central fluid-containing portion is available. However, a variety of other shapes may be used, and the invention is not intended to be limited to a bottle shape.

The cosmetic container 10 may be made from a variety of substances. However, in the preferred embodiment, the container is made of soft gelatin. As described in U.S. Pat. No. 5,063,057 (Spellman et al.), "[g]elatin for soft capsules normally will be selected from low-bloom Type A (170–180 g), Type B (150–172 g), or a mixture of Types A and B." (Col. 3, lines 13–16). Generally, a large variety of synthetic polymers may be used as the gelatin substance. "The polymers may either be water-soluble or water-insoluble. Suitable materials are polymers derived from such monomers as vinyl chloride, vinyl alcohol, vinyl pyrrolidone, furan, acrylonitrile, vinyl acetate, methyl acrylate, methyl methacrylate, styrene, vinyl, ethyl ether, vinyl propyl ether, acrylamide, ethylene, propylene, acrylic acid, methacrylic acid, maleic anhydride, salts of any of the aformentioned acids and mixtures thereof. These materials may be in the form of either homo or copolymers. More specific examples include polyvinyl chloride, polypropylene, acrylic/maleic copolymers, sodium polyacrylate, polyvinyl pyrrolidone and polyvinyl alcohol." (Id., col. 3, lines 31–44). In addition, "[c]ellulose based materials may also be suitable; these include sodium carboxymethyl cellulose, hydroxpropyl methyl cellulose, ethyl cellulose, cellulose acetate and cellulose sulphate esters." (Id., col. 3, lines 45–48).

As illustrated by FIGS. 2 and 6, the central portion 10 is preferably narrow in relation to the overall width W of the container. Most preferably, the overall container is at least three times as wide as the central portion. The central portion may be of a variety of shapes. However, it is preferably of a cylindrical shape, or, alternatively, of an oblong cylindrical shape having an oval-shaped cross section 20 as shown in FIG. 6. The vertical thickness V of the central portion should be small enough to permit the container to be inserted in stacked magazines or in mailings, or to meet other given needs.

The interior of the central portion 10 is a hollow chamber that is designed to contain any of a variety of cosmetics such as perfumes and other fragrances, lotions, creams and pastes. In order to allow the central portion to depress slightly under pressure, however, the chamber should not be filled completely, thus leaving the central portion malleable.

Extending laterally from the central portion and preferably substantially surrounding at least a portion of the central portion is the peripheral portion 14. The peripheral portion is preferably a substantially planar horizontal extension from the central portion and, as noted above, may be of a variety of shapes. Preferably, the peripheral portion is given a neck portion 18 of reduced width, to permit easy access to the cosmetic in the central portion. U.S. Pat. No. 2,134,489 (R. P. Scherer) discloses this technique: "An important feature of my invention is that the sprout or nipple of my capsule is provided with an enlargement or hollow head at its outer end which is connected with the main portion of the sprout through a weakened tubular portion or neck of restricted diameter at which point the sprout may be readily broken for dispensing the capsule content." (Col. 1, lines 32–39).

Importantly, at least a substantial portion of the outer edges 16 of the peripheral portion 14 are thickened solid gelatin, in contrast to the hollow (partially fluid-filled) central portion 12. Further, in the preferred embodiment, the edges are parallel to the central portion, except at the neck 18.

The thickened edges 16 of the peripheral portion need not be as thick as the central portion. However, the edges must be of a sufficient thickness and strength that when the entire container is subjected to a planar force F substantially perpendicular to the plane of the peripheral portion and spread over a plane substantially parallel to the peripheral portion, the edges 16 will absorb sufficient pressure to prevent the force from compressing the central portion the extent that the central portion ruptures. However, as noted above, the central portion may be permitted to depress slightly under this pressure without bursting.

In an alternative embodiment, the peripheral portion may comprise nothing more than thickened ribs 16 connected in some fashion to the central fluid-containing portion. For instance, the thickened ribs 16 may be attached by spokes to the central portion 12. Other formations may also suffice, as long as the thickened ribs serve the above discussed function of buffering a planar force applied to the fragrance sample container.

The fragrance sample container of the present invention may be manufactured by a variety of processes. Preferably, however, the container is formed by the continuous rotary die process illustrated in U.S. Pat. No. 1,970,396 to Robert P. Scherer. This process includes heat sealing two gelatin halves together while simultaneously adding the cosmetic contents to the central fluid-containing portion.

While preferred embodiments of the present invention have been depicted and described, it will be appreciated by those skilled in the art that many modifications, substitutions and changes may be made thereto without departing from the true spirit and scope of the invention.

What is claimed is:

1. An integral cosmetic container of a soft gelatin comprising:

(a) a fluid-containing compartment, having a predetermined nominal volume, containing a fluid-form cosmetic having a fluid volume less than said predetermined nominal volume to provide an underfilled configuration; and (b) a pressure-absorbing means for absorbing substantially planar pressure exerted upon said integral cosmetic container and thereby preventing said fluid-containing compartment from rupturing under said substantially planar pressure, said pressure-absorbing means being cooperatively defined by said soft gelatin, said underfilled configuration, a thin substantially planar web substantially encompassing and smoothly extending from said fluid-containing compartment, and a solid thickened boundary rim extending integrally and substantially about said thin substantially planar web, having a rim thickness transverse to and thicker than said thin substantially planar web.

2. A cosmetic container as in claim 1 wherein said fluid-containing compartment comprises an essentially cylindrical or oblong cylindrical chamber.

3. A cosmetic container as in claim 1 further comprising an access means for opening said fluid-containing compartment and thereby for gaining access to said fluid-form cosmetic.

4. A cosmetic container as in claim 3 wherein said access means comprises a weakened neck portion defined by said thin substantially planar web.

5. An integral capsule made of first and second sheets of a gelatin having a predetermined softness comprising:

a hollow container segment defining a capsule axis and having a predetermined nominal container volume, a first container end and a second container end, said hollow container segment having a container width substantially transverse to and through said capsule axis and thereby defining a capsule plane, said hollow container segment having a container thickness through said capsule axis and substantially transverse to said capsule plane;

a fluid contained within said hollow container segment and having a fluid volume less than said predetermined nominal container volume to define an underfilled configuration;

a thin, smooth and substantially planar main body segment, substantially disposed within said capsule plane and formed by joinder of said first and second sheets, having a first main body end portion at least partially encompassing and extending smoothly from said first container end, a second main body end portion at least partially encompassing and extending smoothly from said second container end, and an interposed weakened neck portion, said first and second main body end portions having a main body thickness transverse to said capsule plane, said main body thickness being less than said container thickness; and a solid thickened boundary rim segment extending integrally and substantially around said thin, smooth and substantially planar main body segment, having a rim thickness transverse to said capsule plane greater than said main body thickness;

said predetermined softness, said underfilled configuration, said first and second main body end portions, said main body thickness, and said solid thickened boundary rim segment cooperating to define pressure-relief means for distributing and absorbing a substantially planar pressure exerted upon said integral capsule in a direction substantially transverse to said capsule plane and for substantially avoiding rupture of said hollow container segment under said pressure;

said first main body end portion being removable by a twisting action to provide an access to said hollow container segment at said interposed weakened neck portion.

6. An integral capsule claimed as in claim 5 wherein said second main body end portion is substantially U-shaped.

7. An integral capsule as claimed in claim 5 wherein said fluid is a cosmetic.

* * * * *